US005246510A

United States Patent [19]

Kovacs et al.

[11] Patent Number: 5,246,510

[45] Date of Patent: Sep. 21, 1993

[54] METHOD FOR PRODUCING A SELECTIVELY SURFACE HARDENED CAST IRON PART

[75] Inventors: Bela V. Kovacs, Bloomfield Hills; John R. Keough, Birmingham, both of Mich.

[73] Assignee: Applied Process, Livonia, Mich.

[21] Appl. No.: 890,852

[22] Filed: Jun. 1, 1992

[51] Int. Cl.[5] ..... C21D 5/00

[52] U.S. Cl. ..... 148/612; 148/615; 148/627

[58] Field of Search ..... 148/612, 615, 616, 617, 148/627, 639

[56] References Cited

U.S. PATENT DOCUMENTS

| | | | |
|---|---|---|---|
| 3,284,251 | 11/1966 | Farrell | 148/583 |
| 3,477,884 | 11/1969 | Schlicht | 420/528 |
| 3,690,957 | 9/1972 | Thompson | 148/542 |
| 3,860,457 | 1/1975 | Vourinen et al. | 148/614 |
| 4,000,011 | 12/1976 | Sato et al. | 148/512 |
| 4,222,793 | 9/1980 | Grindahl | 148/544 |
| 4,312,685 | 1/1982 | Riedl | 148/500 |
| 4,396,442 | 8/1983 | Nakamura et al. | 148/614 |
| 4,487,398 | 12/1984 | Lincoln et al. | 266/120 |
| 4,596,606 | 6/1986 | Kovacs et al. | 148/545 |
| 4,637,844 | 1/1987 | Pfaffman | 148/575 |
| 4,643,079 | 2/1987 | Brann et al. | 92/222 |
| 4,720,312 | 1/1988 | Fukuizumi et al. | 148/512 |
| 4,772,340 | 9/1988 | Kawaguchi et al. | 148/512 |
| 4,880,477 | 11/1989 | Hayes et al. | 148/639 |
| 5,043,028 | 8/1991 | Kovacs et al. | 148/321 |
| 5,064,478 | 11/1991 | Kovacs et al. | 148/615 |

OTHER PUBLICATIONS

Eddy, Jr., W. P., "Liquid Baths For Heat Treating—Oil and Lead," *The Iron Age*, Sep. 1, 1932, pp. 323, A20.

Eddy, Jr., W. P., "Liquid Baths For Heat Treating—Low Temperature Salt Baths," *The Iron Age*, Oct. 20, 1932, pp. 613, A16.

*Primary Examiner*—George Wyszomierski

*Attorney, Agent, or Firm*—Lynn E. Cargill

[57] ABSTRACT

A method for producing a selectively surface hardened cast iron part includes the steps of (a) heating the part to a desired austempering temperature of between about 450° F. and about 800° F. until the entire cast iron part possesses the desired austempering temperature substantially uniformly throughout it; (b) heating only the surface of the cast iron part to an austenitizing temperature of between about 1500° F. and about 1800° F. by immersing the cast iron part in a molten lead or tin bath until a desired thickness of an austenite layer is formed on the surface of the cast iron part, without substantial heating of the interior of the cast iron part; (c) quenching the surface-heated cast iron part in a non-liquid quenching bath atmosphere, i.e. a gaseous atmosphere maintained at the desired austempering temperature, for a time adequate to transform the surface austenite layer to an ausferritic structure; and (d) cooling the cast iron part before bainite is formed in the heat-treated surface layer. In this manner, only the heat-treated surface layer of the cast iron part is hardened, because it is quenched from both sides simultaneously from two sources: self-quenching by the interior of the part, and external quenching by the austempering atmosphere. Typical heating times in step (a) are between about 10 minutes and about 10 hours, and in step (b) are between about 3 seconds and about 10 minutes. The quenching time in step (c) is typically between about 15 minutes and about 8 hours.

11 Claims, 1 Drawing Sheet

METHOD FOR PRODUCING A SELECTIVELY SURFACE HARDENED CAST IRON PART

TECHNICAL FIELD

The present invention is directed generally to the surface hardening of cast parts, and more particularly to the surface austempering of cast iron parts.

BACKGROUND OF THE INVENTION

Traditionally, cast iron parts are formed by first casting molten iron into a desired shape, and then machining the iron casting to the desired dimensions. The intended uses of cast iron parts may require that the parts be hardened or tempered in order to prolong the lifetimes of the part, for example, for improving the wear resistance of the parts. In the past, it has often by the practice to temper an entire cast part by through tempering, that is, by fully tempering the part throughout the whole of its body. Through tempering a part entails heating the entire part to an austenitizing temperature, and then quenching the part (for example, by immersion in an oil or molten salt bath) to cause compressive stresses in the material, and thereby harden the part.

Unfortunately, through tempering has been very expensive, due to long cycle times, high energy consumption, and the formation of low quality parts (this last caused by distortion during the heating stages). Moreover, through tempering has been disadvantageous because the shape of a part may become distorted during heating, quenching, or both, and the hardening achieved upon subsequent quenching makes the part very difficult to machine to the desired final dimensions. Accordingly, a number of prior attempts have been made to harden merely the surface of cast iron parts, while allowing their cores to remain untransformed. While such attempts did yield parts in which only the surfaces of the parts were hardened, such methods have been subject to their own drawbacks.

For example, flame hardening and induction heating have been used to locally heat an area on the surface of a part before the part is quenched to achieve hardening of the surface. A variety of heating methods are disclosed as background in U.S. Pat. No. 5,064,478 (Kovacs et al., Nov. 12, 1991), at column 2, line 20 through column 3, line 2. That description is incorporated by reference herein. Such methods are limited in that they are generally not useful for cast parts which have many protrusions or indentations, because flame hardening and induction heating methods cannot uniformly and perpendicularly heat all of the part surfaces at the same time. Manufacturers using these or comparable methods have experienced problems due to uneven heating, non-homogeneous brittleness and low yield in production. Moreover, surface hardened parts produced by these or other comparable methods are inherently expensive and difficult to manufacture or machine.

One potential solution to the specific problem of uneven heating of the surface of a ferrous cast part is proposed in U.S. Pat. No. 4,637,844 (Pfaffmann, Jan. 20, 1987). The disclosed process entails preheating the part to around its desired isothermal transformation temperature and inductively heating the part to obtain an austentizing temperature to a substantial depth within the part, in a short period of time which is urged nonetheless to be effective to promote the desired metallurgical carbon and/or graphite dissolution in the surface layer.

The induction heating is asserted to be confined to the outer surface of the part, so as not to significantly raise the temperature of the part interior. After induction heating, the part is immersed into an oil bath maintained at the desired isothermal transformation temperature.

The process disclosed in the patent possesses several drawbacks, however. Induction heating processes are well-known to be non-uniform, that is, they heat the exterior of the surface layer to a temperature significantly greater than that to which the remainder of the surface layer is heated. Moreover, for practical reasons, induction heating of the surface of cast parts is conventionally carried out under an ambient atmosphere, so that oxidation of the surface of the part occurs to a significant degree. Additionally, the nature of induction heating permits only a very short time for austenitizing of the surface layer (at least, short in contrast to other methods), so that the stability of the ausferritic layer ultimately formed has a lower stability than would be desired. Lastly, as with other methods, quenching is carried out with a liquid bath of high temperature oil or molten salt. As indicated above, the need for a quenching bath increases the overall cost of producing the parts.

U.S. Pat. No. 5,064,478 mentioned above provides a solution to many but not all of these problems. That patent discloses a method for producing a selectively surface hardened cast iron part which includes the uniform heating of the surface of the part by immersing the part into a molten metallic bath until only a desired thickness of a surface austenite is produced on the part, the bulk of the body of the part remaining unheated. The surface-heated cast iron part is thereafter quenched in a liquid quenching bath maintained at the desired austempering temperature. Because the body of the part remains well below the austenitizing temperature, the part does not deform during surface hardening, and can be pre-finish-machined to its desired final dimensions before the surface hardening is accomplished. Moreover, unlike prior methods, the method of that patent produced a hardened layer to a uniform depth without regard to the shape of the part, avoiding the need for heating to a substantial depth, as required by U.S. Pat. No. 4,637,844.

While very useful for its intended purposes, the method of U.S. Pat. No. 5,064,478 still incurs the cost and inconvenience of the molten salt bath for quenching. It would be desirable and advantageous to devise a method for hardening only the surface of a cast iron part, one which avoided the use of a liquid quenching bath yet enjoyed the limited and uniform heating of the surface provided in U.S. Pat. No. 5,064,478.

Accordingly, it is an object of the present invention to provide a method for producing a selectively surface hardened cast iron part in which the surface tempered layer is uniformly produced without regard to the shape of the part.

It is also an object of the present invention to provide a method for producing a selectively surface hardened cast iron part in which a relatively longer time for austentizing is employed, in contrast to methods entailing induction heating or flame hardening, so as to improve the stability of the ausferritic layer ultimately formed.

It is a further object of the present invention to provide a method for producing a selectively surface hardened cast iron part in which the part formed has a surface free of oxidation and which does not require post treating, such as machining to finish dimensions.

It is yet another object of the present invention to provide a method for producing a selectively surface hardened cast iron part which does not entail quenching in a molten salt bath or oil bath, thus reducing the cost of manufacturing the cast iron part.

SUMMARY OF THE INVENTION

In accordance with a preferred embodiment of the present invention, these and other objects and advantages are addressed as follows:

The present invention is directed to a method for producing a selectively surface hardened cast iron part, comprising the steps of:

(a) heating a cast iron part to a desired austempering temperature of between about 450° F. and about 800° F. until the entire cast iron part possesses the desired austempering temperature substantially uniformly throughout;

(b) heating the surface of the cast iron part to an austenitizing temperature of between about 1500° F. and about 1800° F. by immersing the cast iron part in a molten metallic bath until a desired thickness of an austenite layer is formed on the surface of the cast iron part, without substantial heating of the interior of the cast iron part;

(c) quenching the surface-heated cast iron part in an atmosphere maintained at the desired austempering temperature, for a time adequate to transform the surface austenite layer to an ausferritic structure; and (d) cooling the cast iron part before bainite is formed in the heat-treated surface layer;

whereby only the heat-treated surface layer of the cast iron part is hardened, and the interior of the cast iron part remains substantially unhardened and unheated above the austempering temperature.

"Without substantial heating" means that the interior of the cast iron part remains close enough to the desired austempering temperature that the interior of the part serves as a heat sink to the austempering temperature during quenching of the part. The surface layer on the part is thus quenched from both sides by two simultaneous mechanisms: self-quenching by the interior of the part, and external quenching by the austempering atmosphere. The result is that only the heat-treated surface layer of the cast iron part is hardened.

In a related aspect, the cast iron part is heated in step (a) for between about 10 minutes and about 10 hours. In another related aspect, the surface of the cast iron part is heated in step (b) for between about 3 seconds and about 10 minutes. In yet another related aspect of the invention, the quenching time of step (c) is between about 15 minutes and about 8 hours. Advantageously, the austenitizing temperature is preferably about 1625° F., and the heating of the surface of the cast iron part in step (b) is long enough to yield an austenite layer having a thickness of between about on the order of 1/100 of an inch and ¼ of an inch.

In a second aspect, the present invention is directed to such a process, in which the molten metallic bath is a molten lead bath, and the heating times in steps (a), (b) and (c) are, in combination, as disclosed above.

In a third aspect, the present invention is directed to a method for producing a selectively surface hardened cast iron part comprising steps (a) through (d) as disclosed above, but which further comprises the preliminary step of finish-machining a cast iron part composed of an austemperable compacted graphite iron, gray iron, malleable iron or ductile iron, and in which the step of heating the surface of the cast iron part is carried out so as to yield an austenite layer having a thickness in the range disclosed above.

The disclosed method is particularly advantageous over prior processes in that it produces a cast iron part which is selectively surface hardened, yet which possesses an interior which has remained substantially unhardened and unheated above the austempering temperature. Size distortions, such as sagging or thermal expansion and contraction non-hysterisis effects, are thus affirmatively avoided. This dimensional stability is a particularly critical advantage of the disclosed method, and is achieved because only a thin surface layer of the part is heated to the austenitizing temperature. Also advantageously, production costs will be lowered because the molten salt bath or oil bath previously required for quenching is eliminated, and cycle times are significantly shorter. The disclosed method enjoys other advantages as described in greater detail below.

BRIEF DESCRIPTION OF THE DRAWINGS

The nature and extent of the present invention will be clear from the following detailed description of the particular embodiment thereof, taken in conjunction with the appendant drawing, in which.

DETAILED DESCRIPTION OF THE INVENTION

Figure 1:
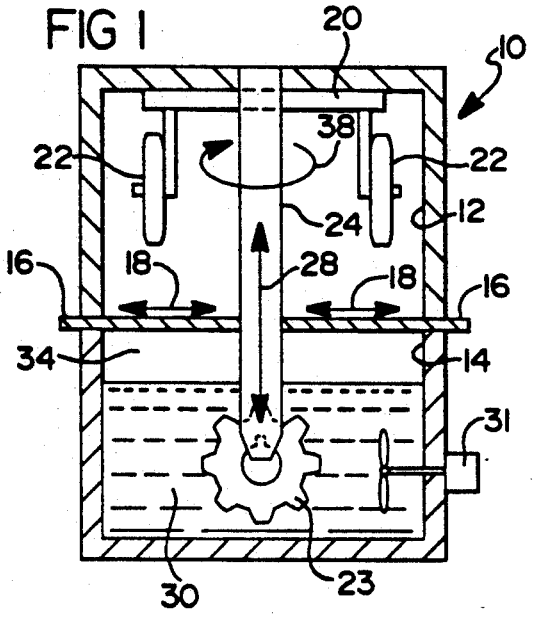
FIG. 1 is a cross-sectional view of an apparatus for carrying out the method of the present invention.
Figure 2:
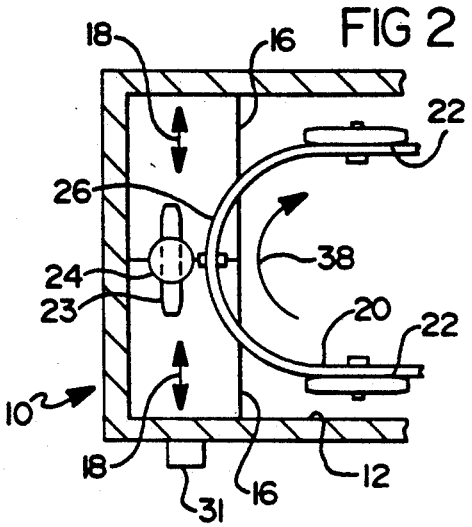
FIG. 2 is a top view of the apparatus shown in FIG. 1.

The method of the present invention for producing a selectively surface hardened cast iron part can be readily understood with reference first to FIGS. 1 and 2, in which an apparatus 10 for carrying out the method of the present invention is shown generally, having an oven chamber 12 and a molten metal bath chamber 14 separated by a pair of doors 16 moveable in the direction of the arrows 18. The oven chamber 12 contains a preferably continuous conveyor system designated generally as 20 for delivering and removing a series of cast iron parts 22 to and from the area of the bath chamber 14. For convenience, the cast iron parts 22 are shown in the Figures as gears, but they can be cast iron parts of any shape or surface configuration.

The cast iron parts 22 can be made of compacted graphite iron, gray iron, malleable iron or ductile iron. The cast iron parts 22 are preferably finish-machined before they are introduced to the conveyor system 20. The composition of the cast iron parts 22 is not believed to be critical to the success of the present invention, so long as appropriate austempering and austenitizing times and temperatures are chosen. Conveniently, however, the composition of the cast iron parts may be any of those disclosed in U.S. Pat. No. 5,043,028 (Kovacs et al., Aug. 27, 1991), U.S. Pat. No. 4,475,956 (Kovacs et al.), U.S. Pat. No. 4,484,953 (Kovacs et al.), U.S. Pat.

No. 4,596,606 (Kovacs et al.), U.S. Pat. No. 4,666,533 (Kovacs et al.) or U.S. Pat. No. 4,737,199 (Kovacs).

The oven chamber 12 contains an atmosphere maintained at a desired austempering temperature appropriate to the composition and nature of the cast iron parts 22. The atmosphere in the oven chamber 12 may include one or more of nitrogen, argon, helium, ambient air or mixtures of these. The atmosphere in the oven chamber 12 serves both to heat the parts 22 to the desired austempering temperature substantially uniformly throughout, and to quench the parts after they are heated in the metal bath chamber 14. Alternatively, a separate quenching chamber could be provided, but employing separate chambers will increase the costs associated with hardening the cast iron parts.

The apparatus 10 for performing the method of the present invention further includes a robotic or other mechanical arm designated generally as 24 positioned at one end 26 of the conveyor system 20. The arm 24 first serves to remove a particular one of the parts 22 (such as a specific part 23) from the conveyor system 20 (so that the part 23 can be heated to an appropriate austenitizing temperature in the bath chamber 14) and return the part 23 to the conveyor system 20 (after such heating). The arm 24 additionally serves to introduce the part 23 into the bath chamber 14 by clamping the part 23 and reciprocating in the direction indicated by arrow 28. The reciprocating movement is carried out so as to rapidly submerge the part 23 into a molten metal bath 30 contained in the bath chamber 14, and rapidly remove the part 23 from the bath 30, in a manner such that only the surface of the cast iron part 23 has been heated to the appropriate austenitizing temperature and the desired thickness of an austenite layer is formed on the surface of the cast metal part 23.

Preferably, the molten metal bath 30 is composed of molten lead or molten tin. These have a high enough surface tension with respect to cast iron that the molten metal does not cling to the cast iron part 23 when the part 23 is removed from the bath chamber 14. The molten lead or molten tin is denser than the cast iron part 23, however, so that the robotic arm 24 preferably clamps onto the cast iron part 23 so as to keep the cast iron part 23 submerged in the molten metal bath 30 for the appropriate time. The chamber 14 may include an agitator 31 for agitating the molten metal bath 30.

Preferably, an insulating layer 34 is provided in the space in the bath chamber 14 above the molten metal bath 30, to prevent the intrusion of oxygen or an oxidizing atmosphere into the bath 30 and to retain heat in the chamber 14. The insulating layer 34 can be a layer of graphite powder floated atop the molten metal bath 30, or can be a layer of spun glass fibers. Preferably, however, the insulating layer 34 is a flowing gas curtain of a carburizing or an inert atmosphere, for example, nitrogen.

It is important to keep the atmosphere immediately adjacent or above the lead bath 30 free of oxygen. A graphite powder layer atop the molten lead bath 30 could serve as an oxygen scavenger. An oil soaked fire-brick placed in the lead bath as an oxygen scavenger is also useful for this purpose.

Use of the apparatus 10 to carry out the method of the present invention is straightforward. The atmosphere in the oven chamber 12 is first established at a desired austempering temperature appropriate to the composition and nature of the metal parts 22, and the molten metal bath 30 established at an austenitizing temperature also appropriate to the composition and nature of the cast iron parts 22. The cast iron parts 22 are then carried by the conveyor system 20 and heated in the oven chamber 12 to the desired austempering temperature (step (a)), until the entire cast iron part possesses the desired austempering temperature substantially uniformly throughout. "Substantially uniformly throughout" means that the part possesses no more than about a plus or minus 5° F. variation in temperature from the surface of the part to the center of its core. The desired austempering temperature for the cast iron parts 22 will be between about 450° F. and about 800° F., again, depending upon the desired mechanical properties of, and to a lesser degree on the particular composition of, the parts 22. Typically, heating the cast iron parts 22 to the desired austempering temperature throughout will take about 10 minutes to about 10 hours.

Advantageously, the conveyor system 20 is intermittently operated in the direction of the arrow 38 so as to sequentially bring each of the cast iron parts 22 to the end 26 of the conveyor when each cast iron part 22 has been heated to the desired austempering temperature substantially uniformly throughout. The robotic arm 24 is then actuated to grasp and clamp the specific part 23 at the end 26 of the conveyor system 20, and remove the part 23 from the conveyor system 20. The doors 16 between the oven chamber 12 and the metal bath chamber 14 are then slid apart, and the arm 24 reciprocated in the direction of arrow 28 to immerse the cast iron part 22 into the molten metal bath 30 contained in the chamber 14. The doors 16 may be slid together during such immersion, in order to retain as much heat as possible in the molten metal bath 30 and reduce the energy costs associated with operation.

The part 23 may be agitated in the bath during immersion, for example, by movement of the robotic arm 24; or the bath 30 may be agitated about the part 23, for example, by actuation of the agitator 31.

Immersion of the cast iron part 23 into the molten metallic bath uniformly heats the entire surface of the cast iron part to the temperature of the bath 30, which is of course the desired austenitizing temperature (step (b)). The particular austenitizing temperature will depend upon the composition and nature of the cast iron parts 22, but will preferably be between about 1500° F. and about 1800° F., more preferably about 1625° F.

The arm 24 maintains the particular cast iron part 23 in the molten metal bath 30 until a desired thickness of an austenite layer is formed on the surface of the cast iron part. Typically, the surface of the cast iron part will be heated in this manner for about 3 seconds to about 10 minutes, depending upon the size of the part. Such heating is carried out, however, without substantial heating of the interior of the cast iron part. "Without substantial heating" means that only the desired thickness of the austenite layer on the particular cast iron part 23 will be hardened upon quenching, and that the interior of the cast iron part 23 remains close enough to the desired austempering temperature that the interior of the cast iron part 23 serves as a heat sink to the austempering temperature during quenching of the part 23.

The time of surface heating also depends upon the thickness of the hardened layer desired, and most importantly, upon the size of the part and the shape of the part. Merely by way of illustration, and not limitation, a 5 inch diameter, thirty-tooth cast iron gear heated on the order of 30 seconds at the preferred austenitizing temperature yielded a hardened layer of ausferrite of about 0.030 inches thickness.

Figure 3:
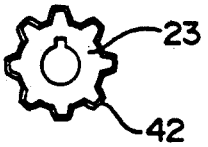
FIG. 3 is a cross-sectional view of a selectively surface hardened cast iron part, specifically, a gear.

The heating of the surface of the particular cast iron part 23 to the desired austenitizing temperature is long enough to yield an austenite layer on the surface of the cast iron part 22 having a thickness of between about on the order of 1/100 of an inch and about ¼ of an inch. The austenite layer is designated as 42 in the cross-sectional view of the particular part 3 shown in FIG. 3. The lower limit for the thickness of the austenite layer is defined as being "about on the order of 1/100 of an inch" because the practical lower limit for the thickness of the layer will depend upon the composition of the part 22 and its shape or surface configuration. On cast iron gear surfaces, for example, austenite layers as thin as 0.007 inches have been achieved by the method of the present invention. The intended end use of a particular cast iron part may make an austenite layer that thin impractical under particular circumstances.

Once the desired thickness of the austenite layer 42 is formed on the surface of the cast iron part 23, the doors 16 are slid apart, and the arm 24 actuated in the direction of arrow 28 to remove the part 23 from the molten metal bath 30 and to return the part 23 to the conveyor system 20. This retraction of the arm 24 immediately introduces the now surface-heated cast iron part 23 into a gaseous quenching atmosphere maintained at the desired austempering temperature, that is, the atmosphere of the oven chamber 12 (step (c)). The surface layer 42 of the part 23 is not quenched solely by the atmosphere in the oven chamber 12, however; since the interior of the cast iron part 23 has remained substantially unheated above the austempering temperature, the interior of the cast iron part 23 simultaneously serves to quench the austenite layer 42 formed on the surface of the cast iron part 23.

The conveyor system 20 holds the cast iron part 23 in the oven chamber 12 for a time adequate to transform the surface austenite layer 42 into a stable ausferritic structure. "Stable" means that the austenite phase of the surface layer becomes supersaturated with carbon to a degree that the austenite phase of the surface is both thermally and mechanically stable. This stability is achieved because the disclosed surface heating by immersion in a molten metal bath provides a relatively longer time for austenitizing than is provided in methods employing flame heating or induction heating. The longer time pulls carbon out from the nodules in the initial cast iron composition beneath the surface layer and puts the carbon into the surface layer, promoting the desired supersaturation of the austenite layer 42. The increase in the amount of carbon in the austenite improves its stability.

The time for quenching in the oven chamber 12 is preferably between about 15 minutes and about 8 hours. This time is dependent upon the composition and nature of the cast iron parts 22, and must not be so long as to permit the formation of bainite in the surface layer. Quenching is most conveniently terminated by removing the surface-heated cast iron part 23 from the oven chamber 12, and allowing it to cool to room temperature in the ambient atmosphere (step (d)).

Figure 4:
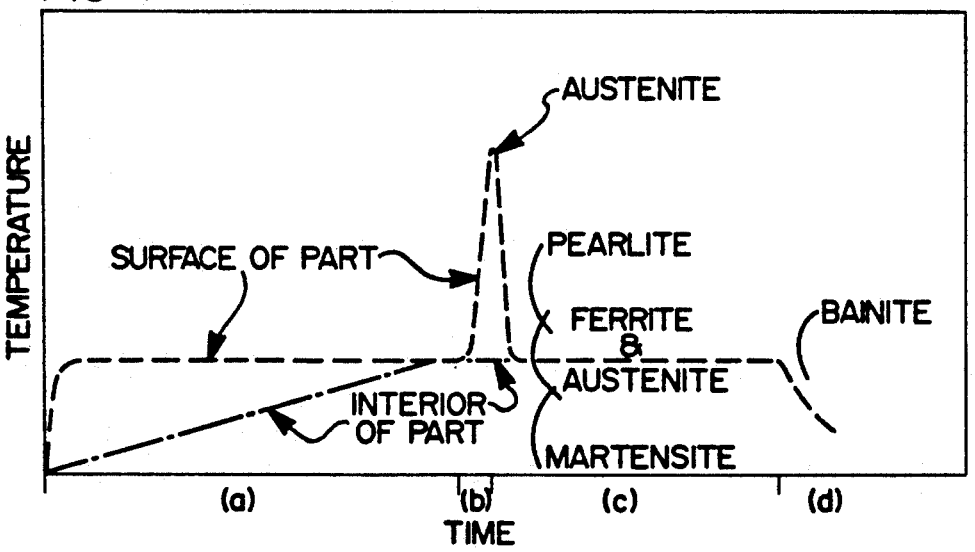
FIG. 4 is a graph of the temperatures of the surface of a part and the interior of a part versus time during the method of the present invention, including the various desired and undesired ranges of composition of the heat-treated surface layer of the cast iron part.

The temperatures obtained in the interior of a cast iron part and on the surface of a cast iron part during the process described above are shown in FIG. 4. Also shown in FIG. 4 are the desired and undesired structures which can be obtained in cast iron at various temperatures. It is clear from FIG. 4 that the desired austempering temperature in the present invention is below the temperature at which pearlite would form, but greater than the temperature at which martensite would form. Additionally, as indicated above, the time of quenching is shorter than the time that would yield bainite in the surface layer 42 of the cast iron part 23.

It should be evident from a comparison of the described process and the temperatures shown in FIG. 4 that the time scale of FIG. 4 is not uniform; the length of time during which the austenite layer is formed on the part is only about 1/60 to about 1/90 of the time required for the total process, but has been expanded in scale in FIG. 4 for clarity. It should also be clear that any heating of the interior of the part during the heating of the surface of the part 23 by the molten bath 30 will be negligible, that is, less than the variation of temperature permitted by the phrase "substantially uniformly throughout" as defined above.

Of course, the particular heating, austenitizing and quenching times and temperatures will depend to a great extent upon the various factors recited above. However, adaptation of these parameters to yield a hardened layer of any desired thickness upon any specific cast iron composition should be readily determinable by one skilled in the art, without undue experimentation in light of the instant disclosure.

Thus, the method of the present invention achieves numerous advantages over prior methods of surface hardening of cast iron parts. The parts can be premachined to their desired size and shape before their surfaces are hardened, since the limited temperature change in the interior core of the parts minimizes any change of the surface dimensions occurring from the hardening process. The method of the present invention also eliminates the previously required oil or molten salt quenching bath, and eliminates the costs and inconveniences accompanying quenching in such baths. The method also affirmatively avoids the formation of martensite, pearlite and bainite in the hardened surface of the parts. The method of the present invention leaves the integrity of the parts intact, because the parts are not heated throughout, but only austenitized on their surfaces.

The present invention is also advantageous in the quality and uniformity of the heating of the surface, in contrast to the lack of uniformity encountered when flame hardening or induction heating were employed. For example, in induction heating of a gear tooth, the tip and root of the tooth will not be at the same temperature, no matter what depth the gear tooth is heated to. The present invention also avoids the surface oxidation that is often encountered in methods employing induction heating. In combination with the surface tension of the molten metal bath, the parts when removed from the bath have a clean and non-oxidized surface, so that no post-treatment of the surfaces is required. Further, as indicated above, the relatively longer time for austenitizing in the present invention, in contrast to flame hardening or induction heating, yields an ausferritic surface layer having improved mechanical and thermal stability. Moreover, this relatively longer austenitizing time permits the present invention to enjoy better process control, in contrast to these other processes.

While the present invention has been described in terms of a specific embodiment, it must be appreciated that other embodiments could readily be adapted by one skilled in the art. Accordingly, the scope of the invention is to be limited only by the following claims.

What is claimed is:

1. A method for producing a selectively surface hardened cast iron part, comprising:

(a) heating a cast iron part to a desired austempering temperature of between about 450° F. and about 800° F. until the entire cast iron part possesses the desired austempering temperature substantially uniformly throughout;

(b) heating the surface of the cast iron part to an austenitizing temperature of between about 1500° F. and about 1800° F. by immersing the cast iron part in a molten metallic bath until a desired thickness of an austenite layer is formed on the surface of the cast iron part, without substantial heating of the interior of the cast iron part;

(c) quenching the surface-heated cast iron part in a non-liquid, gaseous, quenching atmosphere maintained at the desired austempering temperature, for a time adequate to transform the surface austenite layer to an ausferritic structure; and (d) cooling the cast iron part before bainite is formed in the heat-treated surface layer;

whereby only the heat-treated surface layer of the cast iron part is hardened, and the interior of the cast iron part remains substantially unhardened and unheated above the austempering temperature.

2. The method of claim 1, wherein the cast iron part is heated in step (a) for between about 10 minutes and about 10 hours.

3. The method of claim 1, wherein the cast iron part is made of compacted graphite iron, gray iron, malleable iron or ductile iron, and wherein the method further comprises finish-machining the cast iron part before the heating of step (a).

4. The method of claim 1, wherein the molten metallic bath is lead or tin.

5. The method of claim 1, wherein the surface of the cast iron part is heated in step (b) for between about 3 seconds and about 10 minutes.

6. The method of claim 1, wherein the time of quenching in step (c) is between about 15 minutes and about 8 hours.

7. The method of claim 1, wherein during the heating of the surface of the cast iron part in step (b), the part is agitated in the metallic bath or the metallic bath is agitated about the part.

8. The method of claim 1, wherein the heating of the surface of the cast iron part in step (b) is long enough to yield an austenite layer having a thickness of between about on the order of 1/100 of an inch and about ¼ of an inch.

9. The method of claim 1, wherein the austenitizing temperature is about 1625° F.

10. A method for producing a selectively surface hardened cast iron part, comprising:

(a) heating a cast iron part to a desired austempering temperature of between about 450° F. and about 800° F. for between about 10 minutes and about 10 hours until the entire cast iron part possesses the desired austempering temperature substantially uniformly throughout;

(b) heating the surface of the cast iron part to an austenitizing temperature of between about 1500° F. and about 1800° F. by immersing the cast iron part in a molten lead bath for between about 3 seconds and about 10 minutes until a desired thickness of an austenite layer is formed on the surface of the cast iron part, without substantial heating of the interior of the cast iron part;

(c) quenching the surface-heated cast iron part in a non-liquid, gaseous, quenching atmosphere maintained at the desired austempering temperature, for about 15 minutes to about 8 hours to transform the surface austenite layer to an ausferritic structure; and (d) cooling the cast iron part before bainite is formed in the heat-treated surface layer;

whereby only the heat-treated surface layer of the cast iron part is hardened, and the interior of the cast iron part remains substantially unhardened and unheated above the austempering temperature.

11. A method for producing a selectively surface hardened cast iron part, comprising:

finish-machining a cast iron part composed of an austemperable compacted graphite iron, gray iron, malleable iron or ductile iron;

heating the cast iron part to a desired austempering temperature of between about 450° F. and about 800° F. until the entire cast iron part possesses the desired austempering temperature substantially uniformly throughout;

heating the surface of the cast iron part to an austenitizing temperature of between about 1500° F. and about 1800° F. by immersing the cast iron part in a molten metallic bath until an austenite layer having a thickness of between about on the order of 1/100 of an inch to about ¼ of an inch is formed on the surface of the cast iron part, without substantial heating of the interior of the cast iron part;

quenching the surface-heated cast iron part in a non-liquid, gaseous, quenching atmosphere maintained at the desired austempering temperature, for a time adequate to transform the surface austenite layer to an ausferritic structure; and cooling the cast iron part before bainite is formed in the heat-treated surface layer;

whereby only the heat-treated surface layer of the cast iron part is hardened, and the interior of the cast iron part remains substantially unhardened and unheated above the austempering temperature.

* * * * *